US007082726B2

(12) United States Patent
Prenn et al.

(10) Patent No.: US 7,082,726 B2
(45) Date of Patent: Aug. 1, 2006

(54) BUTTERFLY VALVE FOR SKYLIGHT

(75) Inventors: Joseph W. Prenn, San Diego, CA (US); Christian P. Stevens, Oceanside, CA (US); Michael W. Muhlestein, Vista, CA (US)

(73) Assignee: Solatube International, Inc., Vista, CA (US)

( * ) Notice: Subject to any disclaimer, the term of this patent is extended or adjusted under 35 U.S.C. 154(b) by 196 days.

(21) Appl. No.: 10/615,467

(22) Filed: Jul. 7, 2003

(65) Prior Publication Data

US 2005/0005542 A1 Jan. 13, 2005

(51) Int. Cl.
*E04B 7/18* (2006.01)

(52) U.S. Cl. ..... 52/200; 52/22; 52/173.3; 359/597; 126/623

(58) Field of Classification Search ..... 52/1, 52/22, 28–29, 72, 173.3, 199, 200, 39; 137/74–75, 137/375, 530, 601.11, 601.17; 359/234, 359/236, 592, 597; 49/77, 381, 400; 250/226, 250/205; 126/621–623; 251/305
See application file for complete search history.

(56) References Cited

U.S. PATENT DOCUMENTS 3,070,345 A * 12/1962 Knecht ..... 251/212
4,372,485 A * 2/1983 McCabe ..... 126/285 R
4,427,048 A * 1/1984 Osaka et al. ..... 160/107
4,505,069 A * 3/1985 Freeman ..... 52/200
4,517,765 A * 5/1985 Mucha ..... 49/3
4,628,954 A * 12/1986 Dayus ..... 137/75
5,076,316 A * 12/1991 Brown ..... 137/315.16
5,099,622 A * 3/1992 Sutton ..... 52/200
5,546,712 A * 8/1996 Bixby ..... 52/200
5,742,103 A * 4/1998 Ashok ..... 307/105
6,108,226 A * 8/2000 Ghosh et al. ..... 363/142
6,219,977 B1 * 4/2001 Chao et al. ..... 52/200
6,256,947 B1 * 7/2001 Grubb ..... 52/200
6,528,782 B1 * 3/2003 Zhang et al. ..... 250/226
6,947,296 B1 * 9/2005 Hirosawa ..... 363/20

FOREIGN PATENT DOCUMENTS

JP 2003-64831 * 3/2003

* cited by examiner

*Primary Examiner*—Winnie Yip
(74) *Attorney, Agent, or Firm*—John L. Rogitz

(57) ABSTRACT

A valve for selectively blocking the light passageway of a skylight includes a cylindrical shroud and first and second semicircular butterfly valve elements that pivot on respective axles within the shroud to selectively block the skylight. The axles can ride on a common motor-driven cam between a horizontal orientation to block the skylight and a vertical orientation to allow light to pass. The motor can be powered by a universal power supply that can operate at anywhere from below 100 volts to above 270 volts.

19 Claims, 3 Drawing Sheets

BUTTERFLY VALVE FOR SKYLIGHT

FIELD OF THE INVENTION

The present invention relates generally to skylights.

BACKGROUND OF THE INVENTION

Skylights are used to illuminate buildings in a pleasing and energy-conserving way. Tubular skylights such as those made by the present assignee typically have a roof-mounted transparent cover or dome, a light conveying assembly extending down from the dome into the building to a ceiling, and a light diffuser plate covering the bottom of the assembly at the ceiling. The assembly can be tubular, or it can be rectangular or some other geometry if desired.

It is sometimes desirable to stop light from being transmitted through the skylight, e.g., when a person wishes to darken a room during the day. The present invention understands that one way to do this would be to provide a disk-shaped flapper in the light conveying assembly that can be turned parallel to the assembly axis to permit light to pass, and perpendicular to the axis to block light.

The present invention further understands, however, that flapper assemblies used in, e.g., air conditioning ducts are less than optimum in skylight applications. For one thing, a flapper assembly must include a mounting segment in which the flapper turns, with the mounting segment being installed in the passageway sought to be selectively blocked. In the skylight context this means that the segment, which must not only be as wide as the diameter of the flapper but also as long as the flapper diameter to adequately house the flapper, can be excessively long, causing substantial interference during installation in an existing skylight. Moreover, as understood herein many skylight systems are sold world wide, which means that any motor power supply that might be used to allow for electrical operation of the flapper must be capable of using a wide range of voltages. Absent such a "universal" power supply, multiple power supplies must be provided from which a selection can be made to tailor the skylight to the voltage supply capabilities for any particular location of sale.

SUMMARY OF THE INVENTION

A skylight includes a light conveying structure having an upper end covered by a transparent cover and a lower end covered by, e.g., a diffuser plate. A shroud is engaged with the light conveying structure. First and second valve elements are pivotable within the shroud between an open configuration, wherein the light passageway of the skylight is substantially not blocked, and a closed configuration, wherein the light passageway is substantially blocked.

In a preferred embodiment, an actuator, such as a wirelessly controlled or wall switch-controlled DC motor can be energized to cause each valve element to turn on a respective axle. A reduction gear train can be provided to reduce the speed of rotation of the motor to an operating speed of a gear train shaft, with a cam on which each axle rides preferably coupling the shaft to the valve elements to transform one hundred eighty degrees (180°) of rotation of the gear train shaft to ninety degrees (90°) of rotation of the valve elements. Alternatively, a pulley driven by shape memory springs can be coupled to the valve elements to move the valve elements when the springs are energized with current to cause the springs to move.

Each preferred valve element may define a diameter that is larger than the height of the shroud. The shroud may be formed with a lip circumscribing an inner surface of the shroud, with the valve elements engaging the lip in the closed configuration. A universal power supply that operates at voltages at least in the range from about one hundred volts (100V) to about two hundred seventy volts (270V) can energize the motor.

In another aspect, a valve assembly for a skylight includes a shroud defining a light passageway and a butterfly valve in the shroud and movable between an open configuration, wherein elements of the valve extend beyond the shroud and the light passageway is not blocked, and a closed configuration, wherein the elements cooperate to block the light passageway and are completely within the shroud.

In still another aspect, a skylight includes light conveying means for conveying light and shroud means for engaging the light conveying means and defining a light passageway. First and second valve element means are provided for selectively closing the light passageway. The valve element means are pivotable within the shroud means between an open configuration, wherein the light passageway is substantially not blocked, and a closed configuration, wherein the light passageway is substantially blocked.

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
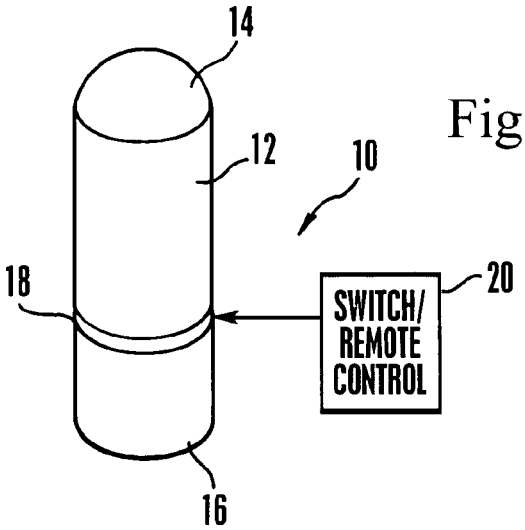
FIG. 1 is a perspective view of the present skylight with butterfly valve shroud installed, schematically showing the user controls.

Referring initially to FIG. 1, a skylight 10 is shown that includes a light conveying structure 12 having an open upper end covered by a transparent preferably roof-mounted dome 14 and an open lower end covered by a preferably ceiling-mounted diffuser plate 16. The light conveying structure 12 may be tubular, rectangular, or other shape. As a non-limiting example, the structure shown in the present figures is tubular, it being understood that the principles set forth herein apply equally to skylights having other shapes.

The light conveying structure 12 may include two segments as shown, with a hollow shroud 18 holding the present butterfly valve being sandwiched between the segments to selectively block light from propagating through the skylight 10. When the skylight is tubular the shroud 18 is cylindrical. As an alternative to placing the shroud 18 between the segments, it may be positioned on either end of the light conveying structure 12. When it is positioned at the top end (i.e., just below the dome 14), the valve elements discussed below can be coated with reflective material to function as reflectors when in the open configuration, to increase the amount of light directed into the skylight 10.

As set forth further below, the valve within the shroud 18 may be activated to open and close. To this end, and actuating device 20 such as a wall-mounted switch or a wireless hand-held user command signal generator that uses rf or IR communicates with components within the shroud 18. Or, a manually-operated linkage can be used to move the valve elements. When a motorized system is used, the actuating device 20 may automatically and incrementally move the valve throughout the day as appropriate to adjust the amount of light being passed through the skylight 10 to establish a constant illumination effect over the course of the day. The movement can be based on a clock or on signals from a light sensor (not shown).

Figure 2:
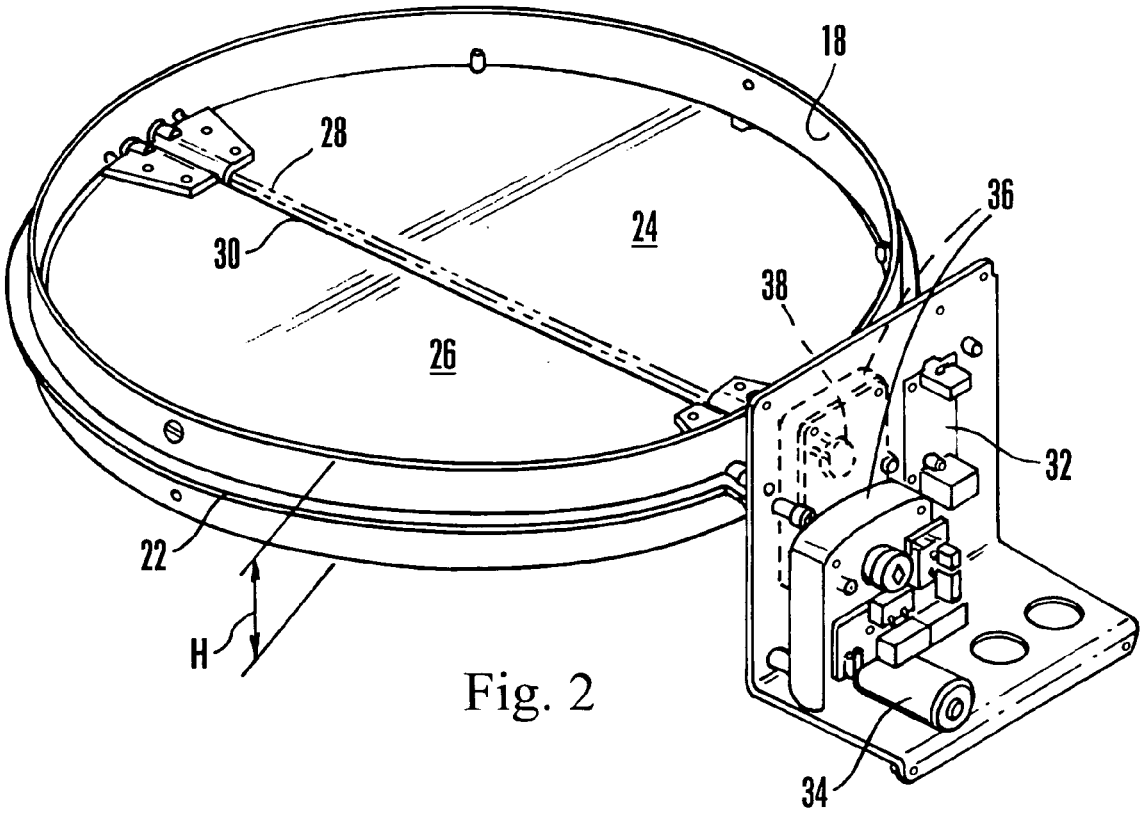
FIG. 2 is a perspective view of the shroud with butterfly valve in the closed configuration, showing portions of the valve element axles and the actuating cam in phantom.
Figure 3:
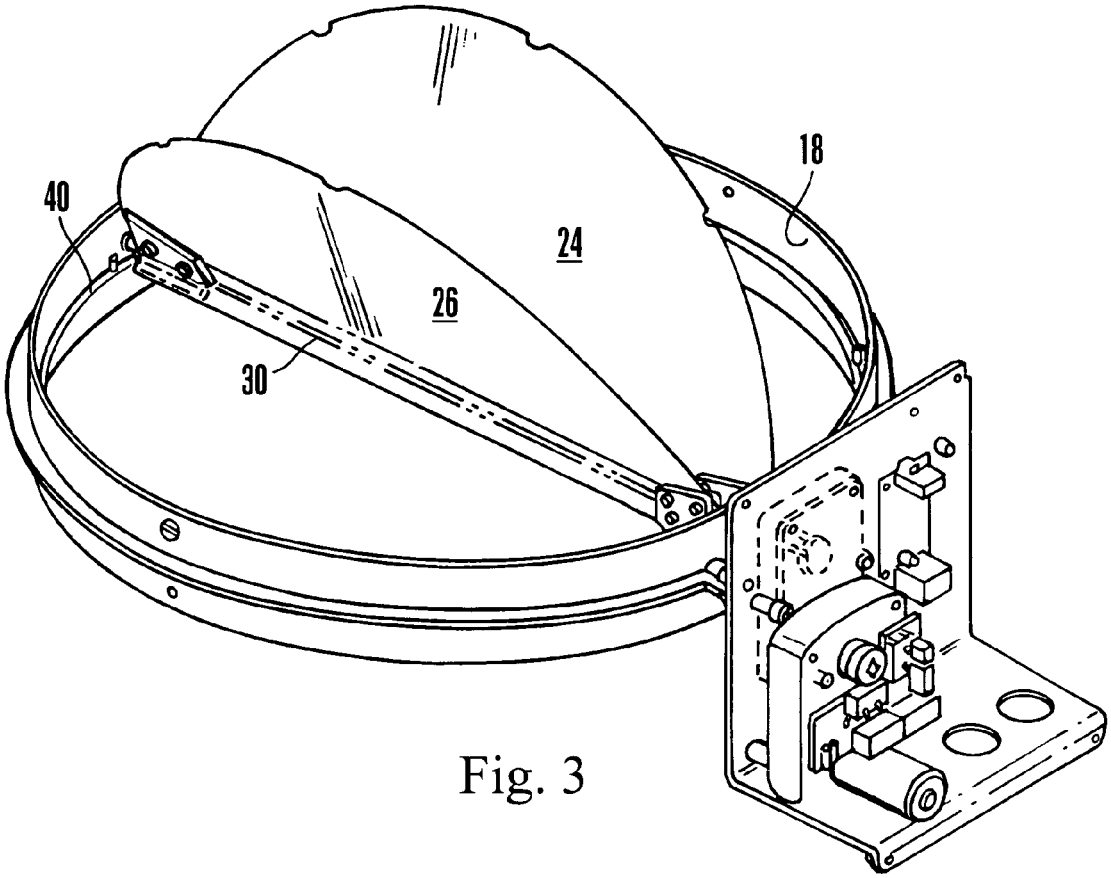
FIG. 3 is a perspective view of the shroud with butterfly valve in the open configuration, showing portions of the valve element axles in phantom.

Now referring to FIGS. 2 and 3, the shroud 18 may be formed with an outer circumferential flange 22 against which the lower edge of the upper tube segment and upper edge of the lower tube segment of the tube structure 14 abut. Also, pivotably disposed within the shroud 18 are first and second semicircular butterfly valve elements 24, 26, which rotate about respective axles 28, 30 between the closed configuration shown in FIG. 2, wherein light passage through the shroud 18 (and, hence, skylight 10) is substantially blocked, and the open configuration shown in FIG. 3, wherein light may pass through the shroud 18. It can be appreciated in cross-reference to FIGS. 2 and 3 that the valve elements 24, 26 rotate through no more than ninety degrees (90°).

To move the axles 28, 30 (and, hence, the valve elements 24, 26), in response to user command signal from the actuating device 20 a power supply 32 receives electrical power from the public power grid or other source and transforms the power to direct current (DC) to drive a DC motor 34. The DC motor 34 in turn is coupled to a reduction gear train housed in a gear train housing assembly 36, with the reduction gears reducing the speed of rotation of the motor 34 to an operating speed of a gear train shaft. The gear train shaft in the preferred embodiment is coupled with a cam 38 that preferably rotates through one hundred eighty degrees (180°). Both axles 28, 30 ride on the cam 38. The cam 38 may be configured such that as it rotates through 180°, each axle 28, 30 rotates through 90°.

Alternatively, a linkage can be provided between the cam 38 and axles 28, 30. The linkage could include a sliding element that provides linear translation of the rotation of the cam. The sliding element can be coupled to a lever that in turn is coupled to the axles to turn the axles and in effect transform translational motion of the linkage back into rotational motion of the axles.

In the embodiment shown, since the valve elements 24, 26 are semicircular, they each define a diameter, with the height "H" of the shroud being substantially smaller than the diameter as shown, resulting in a lower profile and less clearance problems during installation. If desired, as best shown in FIG. 3 the shroud 18 may be formed with a lip 40 that circumscribes the inner surface of the shroud, with the valve elements 24, 26 resting on the lip 40 when in the closed configuration to better seal the light passageway and prevent light leakage. When the light conveying structure 12 is rectangular in transverse cross-section, the valve elements would be rectangular to match the contour of the light conveying structure, and would have a "diameter" defined by the length of their respective edges which are perpendicular to the axes about which they rotate.

The preferred power supply 32 operates to supply DC power to the motor 34 at AC voltages input to the power supply 32 at least in the range from about one hundred volts (100V) to two hundred seventy volts (270V) and more preferably from about ninety volts (90V) to about two hundred seventy seven volts (277V). The power supply may be a UMEC power supply model no. UM-0051(A)-0552, with a secondary transformer added to increase its operational voltage range.

Figure 4:
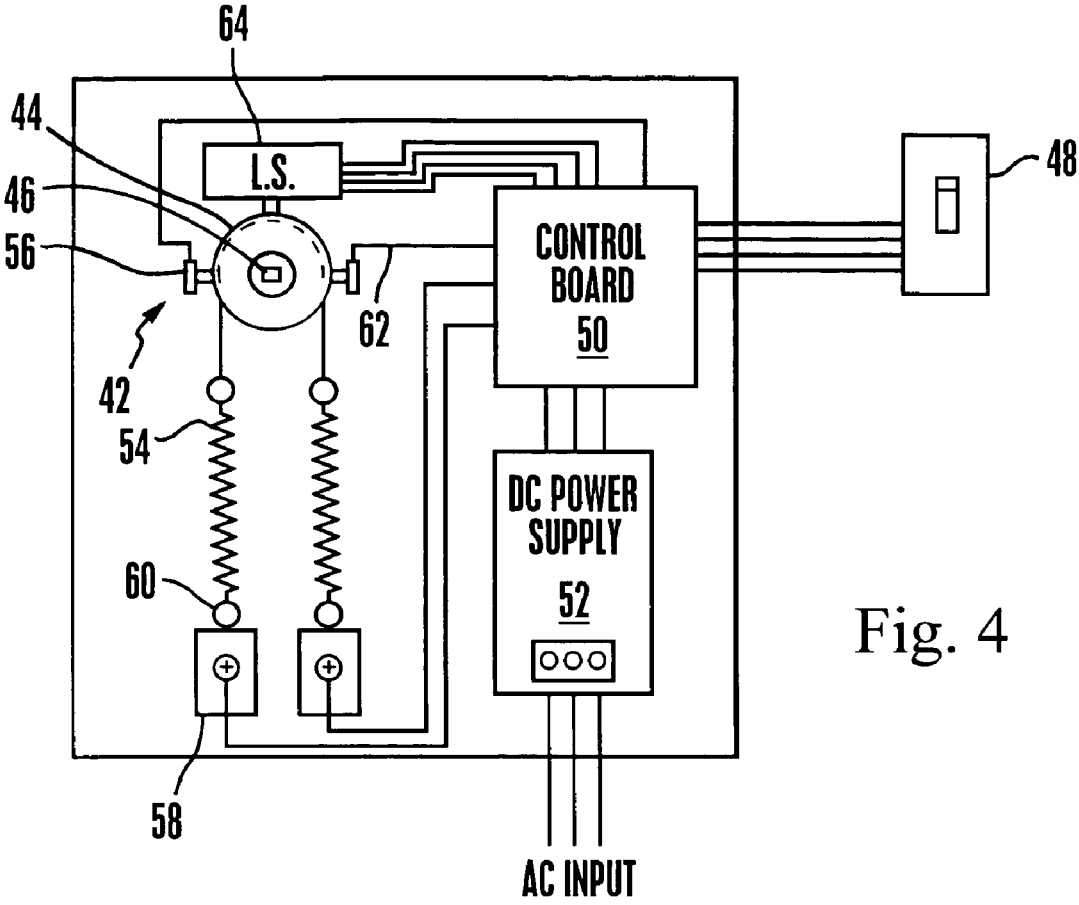
FIG. 4 is a schematic diagram of an alternate drive circuit that uses shape memory wires and a pulley instead of a motor.
Figure 5:
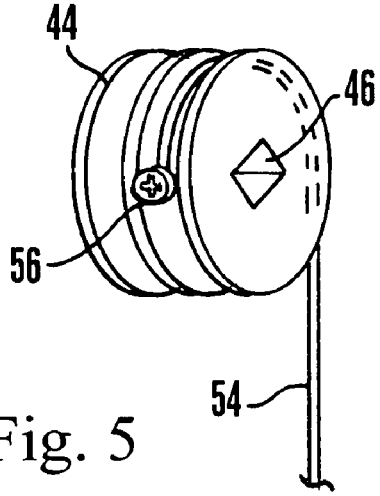
FIG. 5 is a perspective view of the pulley shown in FIG. 4.

FIGS. 4 and 5 show that the motor 34 may be replaced by a shape memory spring-and-pulley system, generally designated 42. A pulley 44 defines a rotational axis 46 that is coupled to the cam 38 or directly to the axles 28, 30 shown in FIG. 2. The pulley 44 can be turned to operate the valve elements shown in FIGS. 2 and 3 by a person manipulating an input device such as a double pull-double throw wall switch 48 or, alternatively, a remote control device. In either case, the signal from the input device to open or close the valve is sent to a control circuit board 50 that includes circuitry for receiving power from the AC grid as rectified by a DC power supply 52 to send (or remove) heating current to shape memory springs 54 that are coupled to the pulley 44. Specifically, each spring 54 is connected to the pulley 44 at a respective negative terminal 56, and each spring 54 is also attached to a respective fixedly mounted positive terminal block 58 at a respective positive terminal 60. Current flows in the circuit defined by the springs 54, terminals 56, 60, leads 62, and control board 50. The shape memory springs 54 can be Nitonel springs made by, e.g., Furukawa Electric that contract and expand when cooled and heated. Preferably, as shown in FIG. 5 each spring 54 wraps around about one hundred eighty degrees of the circumference of the pulley 44.

Accordingly, when it is desired to move the valve elements shown in FIGS. 2 and 3 in a first direction, current is sent through the appropriate one of the springs 54 by the control board 50 to cause the spring 54 to expand or contract as appropriate to turn the pulley 44 clockwise. When it is desired to move the valve elements shown in FIGS. 2 and 3 in the opposite direction, current is sent through the other spring 54 by the control board 50 to cause the other spring 54 to expand or contract as appropriate to turn the pulley 44 counterclockwise. A limit switch assembly 64 may be provided to sense when the pullet 44 has turned through ninety degrees and to send an "off" signal to the control board 50 to deenergize the springs 54 and cause the pulley 44 to stop turning.

While the particular BUTTERFLY VALVE FOR SKYLIGHT as herein shown and described in detail is fully capable of attaining the above-described objects of the invention, it is to be understood that it is the presently preferred embodiment of the present invention and is thus representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more". Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. §112, sixth paragraph, unless the element is expressly recited using the phrase "means for" or, in the case of a method claim, the element is recited as a "step" instead of an "act". Absent express definitions herein, claim terms are to be given all ordinary and accustomed meanings that are not irreconciliable with the present specification and file history. WE CLAIM:

What is claimed is:

1. A skylight, comprising:

at least one light conveying structure having an upper end covered by a transparent cover and a lower end covered by a cover;

first and second valve elements pivotable between am open configuration, wherein a light passageway of the skylight is substantially not blocked, and a closed configuration, wherein the light passageway is substantially blocked;

a motor;

a reduction gear train reducing a speed of rotation of the motor to an operating speed of a gear train shaft; and a cam coupling the shaft to the valve elements to transform one hundred eighty degrees (180°) of rotation of the gear train shaft to ninety degrees (90°) of rotation of the valve elements.

2. The skylight of claim 1, wherein each valve element turns an a respective axle.

3. The skylight of claim 1, wherein each valve element defines a diameter and the elements are disposed in a shroud separate from and coaxially engaged with the light conveying structure, and the shroud defines a height loss than the diameter.

4. The skylight of claim 1, wherein the valve elements are disposed in a shroud separate from and coaxially engaged with the light conveying structure, the shroud being formed with a lip circumscribing an inner surface of the shroud, the valve elements engaging the lip in the closed configuration.

5. The skylight of claim 1, wherein the motor is wirelessly controlled.

6. The skylight of claim 1, wherein the motor is controlled by a switch.

7. The skylight of claim 1, comprising a power supply to power the motor, the power supply operating to supply power at voltages at least in the range from about one hundred volts (100V) to about two hundred seventy volts (270V).

8. The skylight of claim 1, wherein each valve element turns on a respective axle, and each axle rides on the cam.

9. A valve assembly for a skylight, comprising:

a shroud defining a light passageway; and a butterfly valve in the shroud and movable between an open configuration, wherein the light passageway is not blocked, and a closed configuration, wherein the valve blocks the light passageway and is completely within the shroud; and a power supply to supply power to move the valve, the power supply operating to supply power when the voltage input to the power supply is about one hundred volts (100V), the power supply also supplying power to move the valve when the voltage input to the power supply is about two hundred seventy volts (270V), wherein the valve has at least two valve elements and each valve element turns on a respective axle.

10. The assembly of claim 9, wherein the valve elements are pivotable within the shroud between the open configuration and closed configuration.

11. The assembly of claim 10, wherein the shroud is formed with a lip circumscribing an inner surface of the shroud, the valve elements engaging the lip in the closed configuration.

12. The assembly of claim 10, comprising an actuator actuating the valve elements.

13. The assembly of claim 10, wherein the actuator includes a motor and the assembly comprises:

a reduction gear train reducing a speed of rotation of the motor to an operating speed of a gear train shaft; and a cam coupling the shaft to the valve elements to transform one hundred eighty degrees (180°) of rotation of the gear train shaft to ninety degrees (90°) of location of the valve elements.

14. The assembly of claim 13, wherein each valve element turns on a respective axle, and each axle rides on the cam.

15. A skylight, comprising:

light conveying means for conveying light;

shroud means for engaging the light conveying means and defining a light passageway; and first and second valve element means for selectively closing the light passageway, the valve element means being pivotable within the shroud means between an open configuration, wherein the light passageway is substantially not blocked, and a closed configuration, wherein the light passageway is substantially blocked;

actuator means for actuating the valve element means;

a reduction gear train reducing a speed of rotation of the actuator means to an operating speed of a gear train shaft; and a cam coupling the shaft to the valve element means to transform rotation of the gear train shaft to rotation of she valve element means.

16. The skylight of claim 15, wherein each valve element means turns on a respective axle.

17. The skylight of claim 15, wherein each valve element means defines a diameter and the shroud means defines a height less than the diameter.

18. The skylight of claim 15, wherein the shroud means is formed with a lip means for engaging the valve element means in the closed configuration.

19. The skylight of claim 17, comprising power supply means for powering the actuator means, the power supply means operating at voltages at least in the range from about one hundred volts (100V) to about two hundred seventy volts (270 V).

* * * * *